US010751717B2

(12) United States Patent
Chang et al.

(10) Patent No.: US 10,751,717 B2
(45) Date of Patent: Aug. 25, 2020

(54) MICROFLUIDIC CHIP

(71) Applicant: National Cheng Kung University, Tainan (TW)

(72) Inventors: Hsien-Chang Chang, Tainan (TW); Tien-Chun Tsai, Kaohsiung (TW); Yen-Liang Cho, Tainan (TW); Zong-Zhan Wu, Tainan (TW); Peng-Ting Chen, Kaohsiung (TW)

(73) Assignee: National Cheng Kung University, Tainan (TW)

( * ) Notice: Subject to any disclaimer, the term of this patent is extended or adjusted under 35 U.S.C. 154(b) by 261 days.

(21) Appl. No.: 15/996,750

(22) Filed: Jun. 4, 2018

(65) Prior Publication Data

US 2019/0291108 A1 Sep. 26, 2019

(30) Foreign Application Priority Data

Mar. 23, 2018 (TW) ..... 107109959 A

(51) Int. Cl.
*B01L 3/00* (2006.01)

(52) U.S. Cl.
CPC . *B01L 3/502753* (2013.01); *B01L 2200/0647* (2013.01); *B01L 2300/0809* (2013.01); *B01L 2300/16* (2013.01)

(58) Field of Classification Search
CPC ..... B01L 3/502753; B01L 2300/0809; B01L 2300/16; B01L 2200/0647; B01L 2200/0668; B01L 2200/0652; B01L 2300/0645; B01L 2400/0424; B01L 2400/0418; B01L 3/502761
See application file for complete search history.

(56) References Cited

U.S. PATENT DOCUMENTS

2015/0065394 A1* 3/2015 Sando ..... G01N 33/54306 506/16

* cited by examiner

*Primary Examiner* — Jennifer Wecker
*Assistant Examiner* — Michael Paul Shimek
(74) *Attorney, Agent, or Firm* — TraskBritt

(57) ABSTRACT

A microfluidic chip for collecting dielectric particles in a fluid sample to be tested includes an insulating substrate, a first interdigitated electrode, a second interdigitated electrode, and a dielectric layer. The dielectric layer is formed on the first and second interdigitated electrodes and is made from a semiconductive inorganic material having a dielectric constant of from 3.7 F/m to 80 F/m.

8 Claims, 8 Drawing Sheets

MICROFLUIDIC CHIP

CROSS-REFERENCE TO RELATED APPLICATION

This application claims priority of Taiwanese Application No. 107109959, filed on Mar. 23, 2018.

FIELD

The disclosure relates to a microfluidic chip, and more particularly to a microfluidic chip for collecting dielectric particles in a fluid sample to be tested.

BACKGROUND

Flow of dielectric particles in a fluid sample tested by a microfluidic chip is primarily controlled by interaction of dielectrophoresis force and alternating voltage electroosmosis force.

Applicant's Taiwanese Patent No. I507803 discloses a dielectric particle controlling chip and a method of manufacturing the same. The dielectric particle controlling chip includes a chip body, a first interdigitated electrode disposed on the chip body, a second interdigitated electrode disposed on the chip body and spaced apart from the first interdigitated electrode, and a dielectric layer disposed securely on the chip body and covering the first and second interdigitated electrodes. The dielectric layer is used to increase the alternating voltage electroosmosis force and reduce the dielectrophoresis force so as to enhance flow of the dielectric particles in the controlling chip and concentration of the dielectric particles at specific areas of the controlling chip for subsequent detection.

However, the dielectric layer of the dielectric particle controlling chip is made from a photoresist material, such as SU-8 photoresist. The thickness of the dielectric layer is as high as about 1200 nm, which results in a relatively far distance between the dielectric particles in the fluid sample and the interdigitatedelectrodes. Therefore, a relatively high voltage input of at least 40 $V_{pp}$ and a relatively high driving voltage frequency of at least 1000 Hz are required to drive the flow of the dielectric particles in the controlling chip and the concentration of the dielectric particles at specific areas of the controlling chip.

SUMMARY

An object of the disclosure is to provide a microfluidic chip to overcome the aforesaid shortcoming of the prior art.

According to the disclosure, there is provided a microfluidic chip for collecting dielectric particles in a fluid sample to be tested. The microfluidic chip comprises an insulating substrate, a first interdigitated electrode, a second interdigitated electrode, and a dielectric layer.

The insulating substrate defines an electrode-forming region which includes a first zone, a second zone spaced apart from the first zone, and an intermediate zone disposed between the first and second zones.

The first interdigitated electrode includes a first base electrode portion and a plurality of first finger electrode portions. The first base electrode portion is deposited on the first zone. The first finger electrode portions are deposited on the intermediate zone and are displaced from each other. Each of the first finger electrode portions extends from the first base electrode portion toward the second zone to terminate at a first finger end.

The second interdigitated electrode includes a second base electrode portion and a plurality of second finger electrode portions. The second base electrode portion is deposited on the second zone and is spaced apart from the first finger end of each of the first finger electrode portions by a first clearance. The second finger electrode portions are deposited on the intermediate zone, and extend from the second base electrode portion toward the first zone to interdigitate with the first finger electrode portions of the first interdigitated electrode. Each of the second finger electrode portions has a second finger end which is spaced apart from the first base electrode portion of the first interdigitated electrode by a second clearance.

The dielectric layer is formed on the first and second interdigitated electrodes and is made from a semiconductive inorganic material having a dielectric constant of from 3.7 F/m to 80 F/m.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
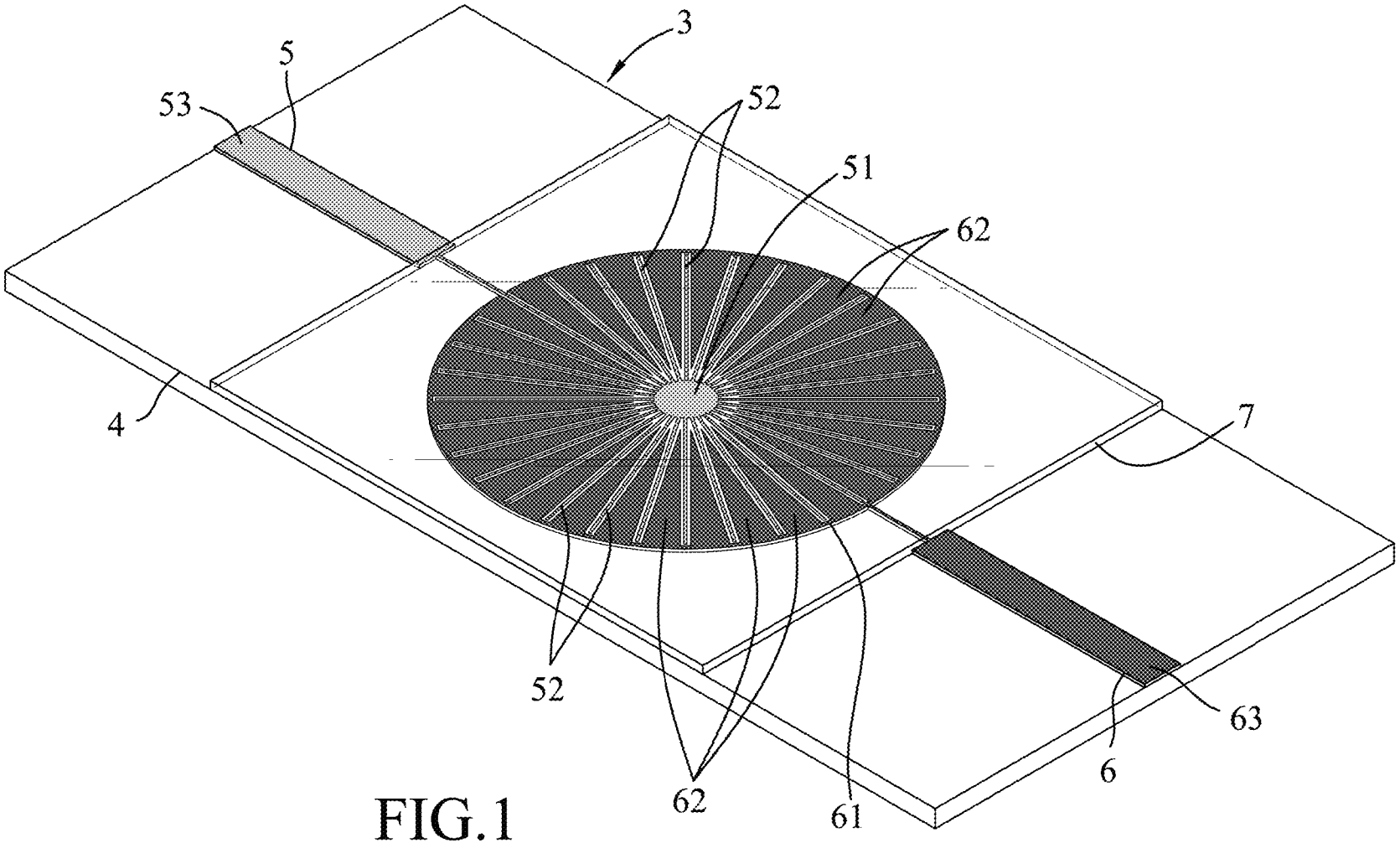
FIG. 1 is a perspective view of a first embodiment of a microfluidic chip for collecting dielectric particles in a fluid sample according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
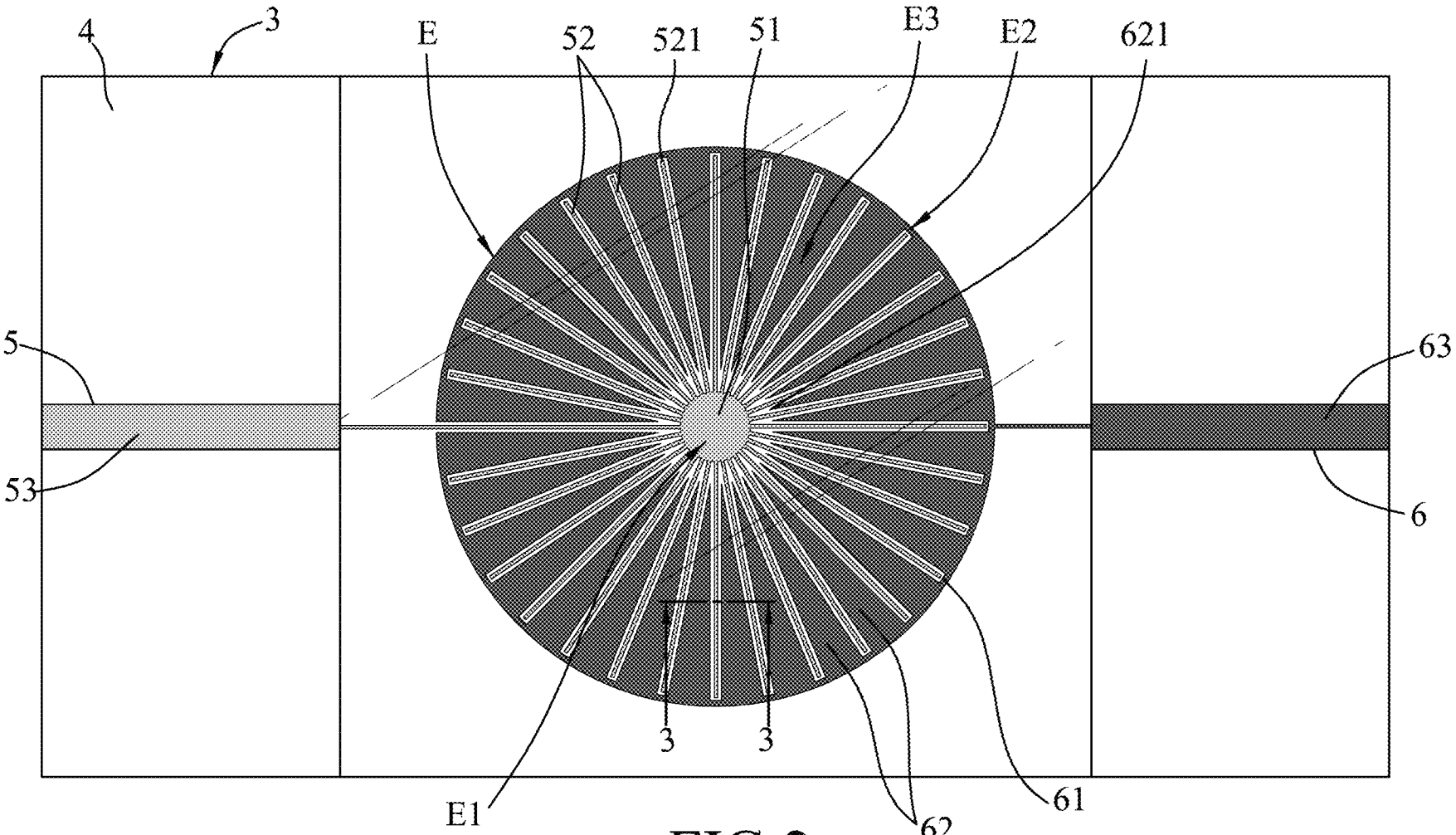
FIG. 2 is a top view of the first embodiment.
Figure 3:
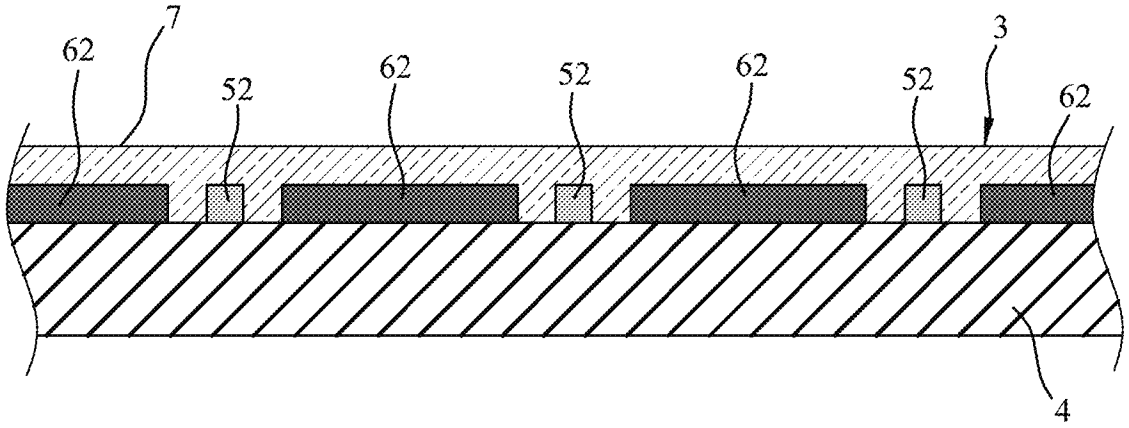
FIG. 3 is a fragmentary sectional view of taken along line 3-3 in FIG. 2.
Figure 4:
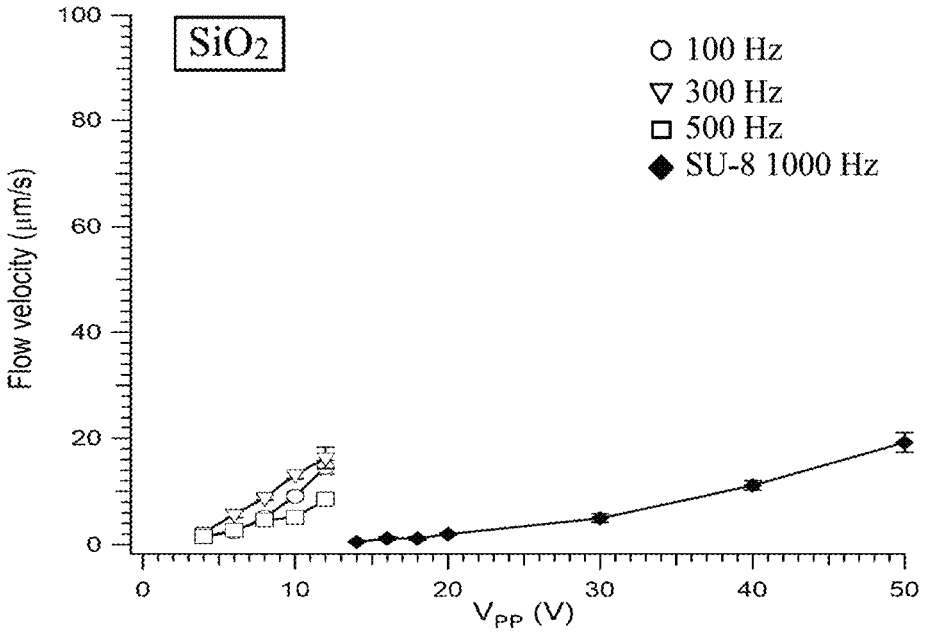
FIG. 4 is a diagram showing relationship between flow velocity and input voltage of the first embodiment in which silicon dioxide ($SiO_2$) is used for forming a dielectric layer contained in the first embodiment.
Figure 5:
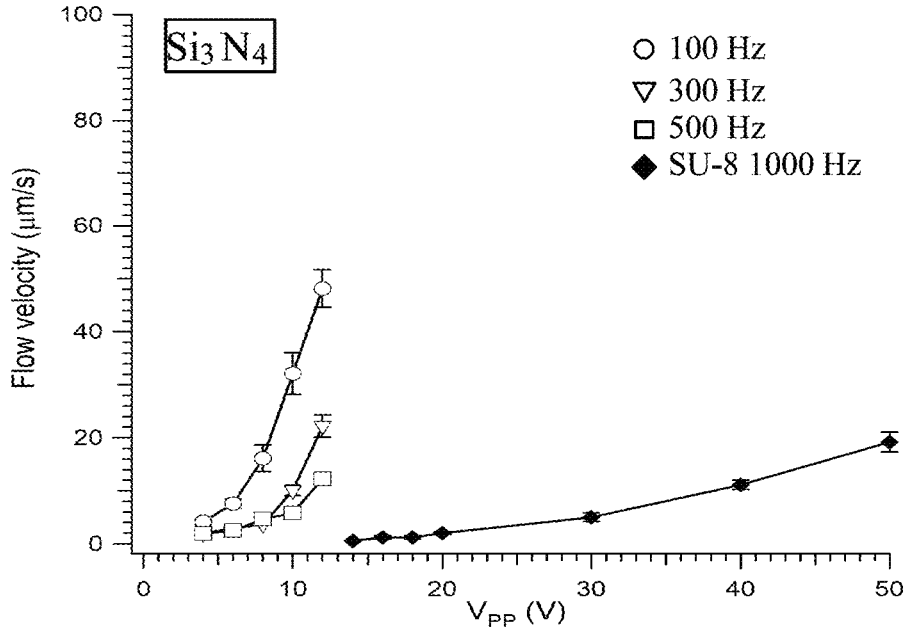
FIG. 5 is a diagram showing relationship between flow velocity and input voltage of the first embodiment in which silicon nitride ($Si_3N_4$) is used for forming the dielectric layer.
Figure 6:
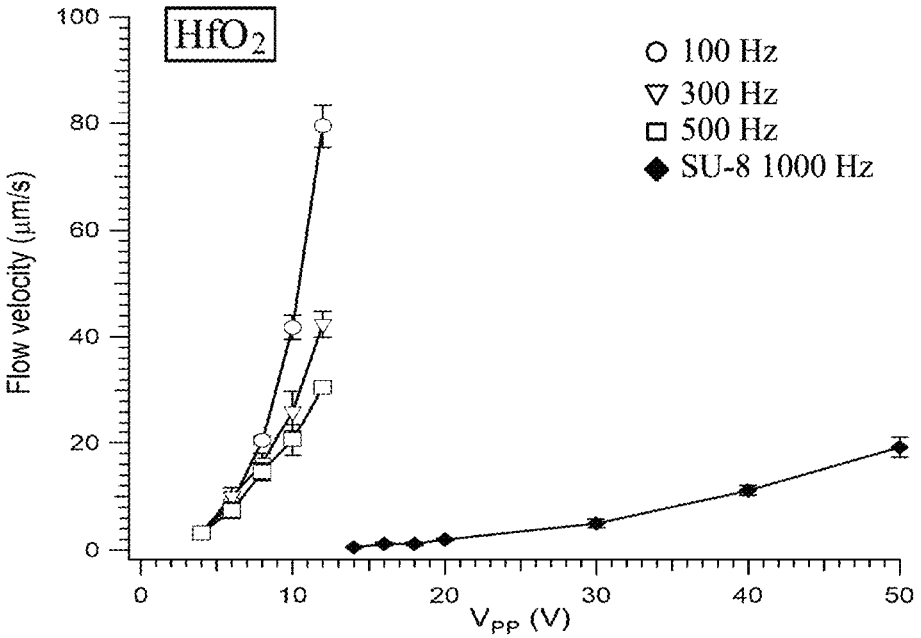
FIG. 6 is a diagram showing relationship between flow velocity and input voltage of the first embodiment in which hafnium dioxide ($HfO_2$) is used for forming the dielectric layer.
Figure 7:
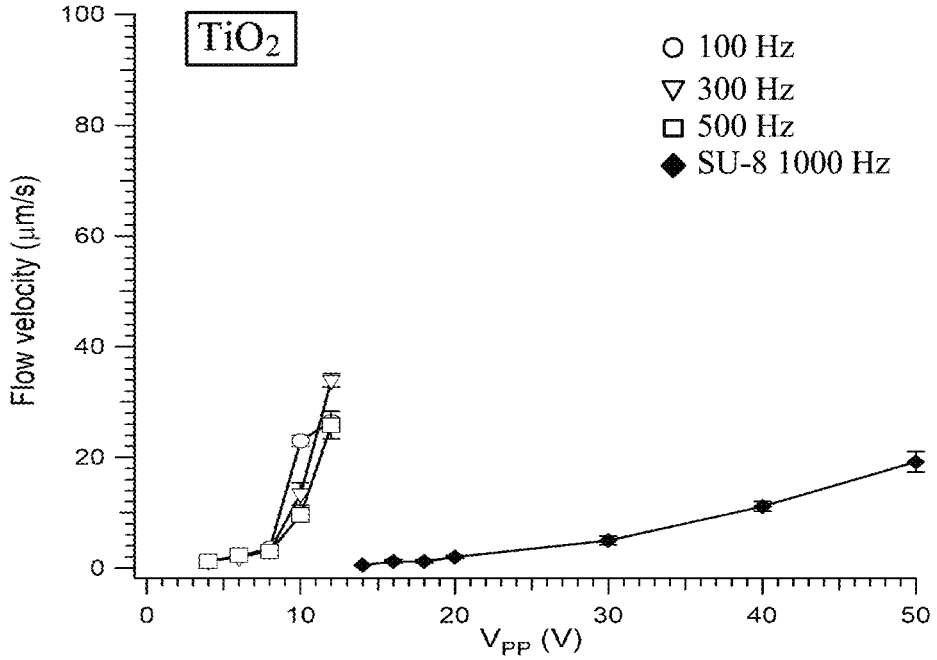
FIG. 7 is a diagram showing relationship between flow velocity and input voltage of the first embodiment in which titanium dioxide ($TiO_2$) is used for forming the dielectric layer.

Referring to FIGS. 1, 2, and 3, a first embodiment of a microfluidic chip according to the disclosure is used for controlling transportation, combination, collection, and concentration of dielectric particles in a fluid sample to be tested. Examples of the dielectric particles include, but are not limited, latex particles, and microparticles of microorganisms such as cells, bacteria, and yeasts.

The microfluidic chip 3 comprises an insulating substrate 4, a first interdigitated electrode 5, a second interdigitated electrode 6, and a dielectric layer 7.

It should be noted that the first interdigitated electrode 5, the second interdigitated electrode 6, and the dielectric layer 7 are of sizes in order of micrometers or nanometers, and that the sizes thereof are exaggeratedly shown in the figures for the purposed of convenient illustration and are not in scale.

The insulating substrate 4 defines an electrode-forming region (E) which includes a first zone (E1), a second zone (E2) spaced apart from the first zone (E1), and an intermediate zone (E3) disposed between the first and second zones (E1, E2).

The first interdigitated electrode 5 includes a first base electrode portion 51, a plurality of first finger electrode portions 52, and a first conductive portion 53. The first base electrode portion 51 is deposited on the first zone (E1). The first finger electrode portions 52 are deposited on the intermediate zone (E3) and are displaced from each other. Each of the first finger electrode portions 52 extends from the first base electrode portion 51 toward the second zone (E2) to terminate at a first finger end (521). Specifically, in the embodiment, the first base electrode portion 51 is of a circular shape, and the first finger electrode portions 52 extend radially and outwardly from the first base electrode portion 51. Each of the first finger electrode portions 52 is configured as a strip. The first conductive portion 53 is configured as a strip extending outwardly from the first base electrode portion 51 to electrically connect an alternating voltage power source.

The second interdigitated electrode 6 includes a second base electrode portion 61, a plurality of second finger electrode portions 62, and a second conductive portion 63. The second base electrode portion 61 is deposited on the second zone (E2) and is spaced apart from the first finger end 521 of each of the first finger electrode portions 52 by a first clearance. The second finger electrode portions 62 are deposited on the intermediate zone (E3), and extend from the second base electrode portion 61 toward the first zone (E1) to interdigitate with the first finger electrode portions 52 of the first interdigitated electrode 5. Each of the second finger electrode portions 62 has a second finger end 621 which is spaced apart from the first base electrode portion 51 of the first interdigitated electrode 5 by a second clearance. Specifically, in the embodiment, the second base electrode portion 61 is of an annular shape surrounding the first finger electrode portions 52, and the second finger electrode portions 62 extend radially and inwardly from the second base electrode portion 61. Each of the second finger electrode portions 62 is configured to converge toward the first base electrode portion 51. The second conductive portion 63 is configured as a strip extending outwardly from the second base electrode portion 61 to electrically connect the alternating voltage power source.

Each of the first interdigitated electrode 5 and the second interdigitated electrode 6 is made from, for example, indium tin oxide and is deposited on the insulating substrate 4 via a micro-electro-mechanical process. In the illustrated embodiment, the first base electrode portion 51 has a radium of 400 μm. Each of the first finger electrode portions 52 has a width of 50 μm and a length of 3150 μm. The second base electrode portion 61 has an inner radium of 3180 μm. A spacing distance between each of the first finger electrode portions 52 and a corresponding one of the second finger electrode portions 62 is 35 μm. The first clearance between the second base electrode portion 61 and the first finger end 521 of each of the first finger electrode portions 52 is 30 μm.

The dielectric layer 7 is formed on the first and second interdigitated electrodes 5, 6 and is made from a semiconductive inorganic material having a dielectric constant of from 3.7 F/m to 80 F/m. Examples of the semiconductive inorganic material suitable for forming the dielectric layer 7 includes, but are not limited to, silicon dioxide ($SiO_2$), hafnium dioxide ($HfO_2$), titanium dioxide ($TiO_2$), silicon nitride ($Si_3T_4$), and combinations thereof. The dielectric layer 7 is formed by a coating process such as electroplating, physical vapor deposition, chemical vapor deposition, spin coating (for example, a spin-on-glass process or a spin-on-dielectric process), and the likes. The dielectric layer 7 thus formed has a thickness ranging from 100 nm to 300 nm.

In use of the microfluidic chip 3, the first interdigitated electrode 5 and the second interdigitated electrode 6 are supplied with a specific AC voltage with a predetermined frequency, a predetermined waveform, and a phase difference of 180°. The first finger electrode portions 52 and the second finger electrode portions 62 are driven accordingly to produce negative dielectrophoresis force so as to permit the dielectric particles suspended in a fluid sample to flow toward a top surface of the dielectric layer 7 as well as the first finger electrode portions 52 and the second finger electrode portions 62, while AC electroosmosis force formed between the first interdigitated electrode 5 and the second interdigitated electrode 6 drives the dielectric particles to flow toward the first base electrode portion 51 so as to concentrate the dielectric particles for collection.

Figure 9:
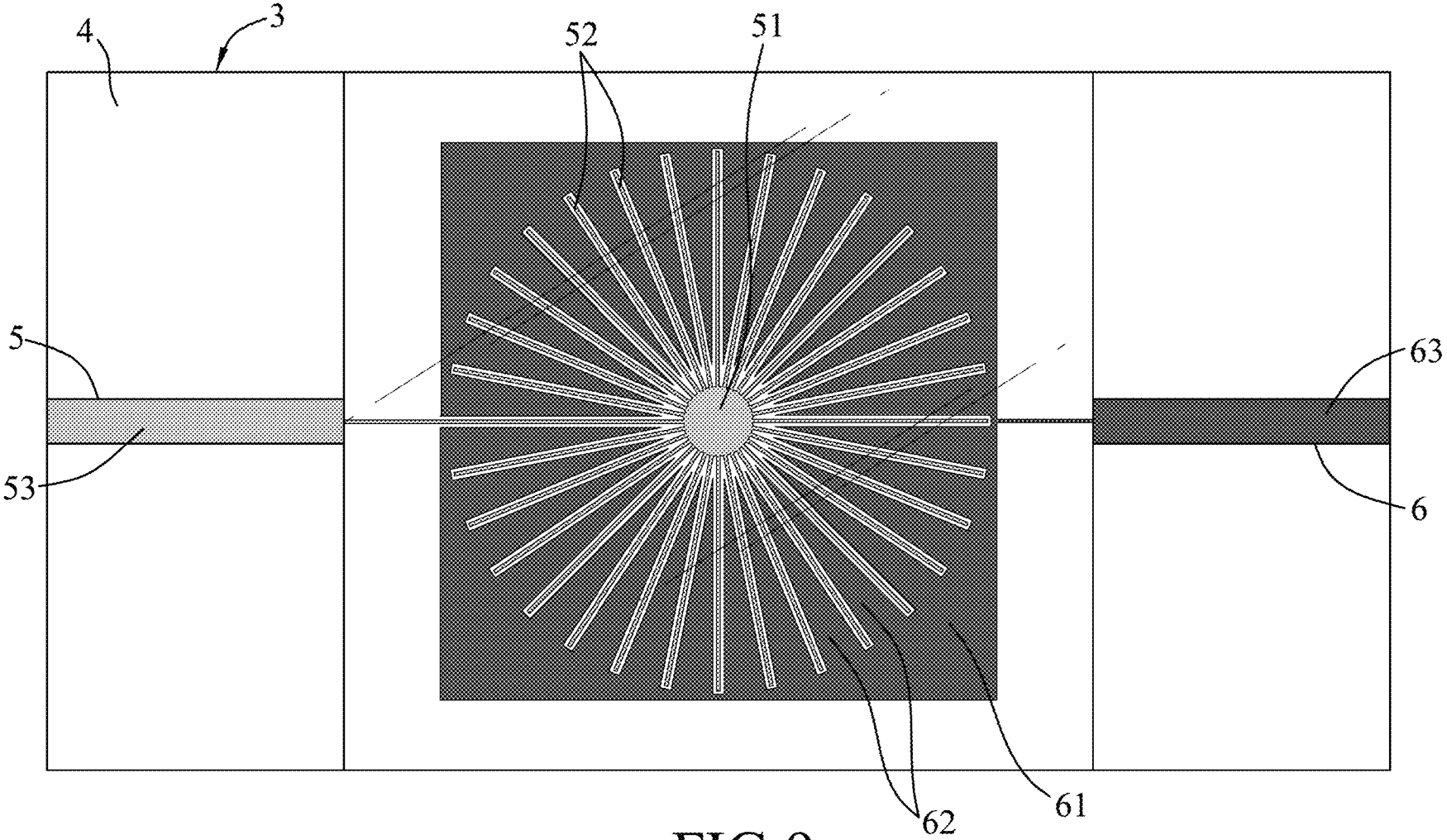
FIG. 9 is a top view of a variation of the first embodiment.

Referring to FIG. 9, a variation of the first embodiment is shown to illustrate that the second base electrode portion 61 may be of a geometric shape other than the annular shape as shown in FIG. 2

It should be noted that the operating conditions (for example, driving voltage and driving voltage frequency) for the alternating current supplied to the first and second interdigitated electrodes 5, 6 may be adjusted according to the dielectric particles in a fluid sample to be tested. Adjustment of the operating conditions for the alternating current supplied to the first and second interdigitated electrodes 5, 6 according to the dielectric particles in a fluid sample to be tested is well known in the art, and thus is not further described in details.

Figure 10:
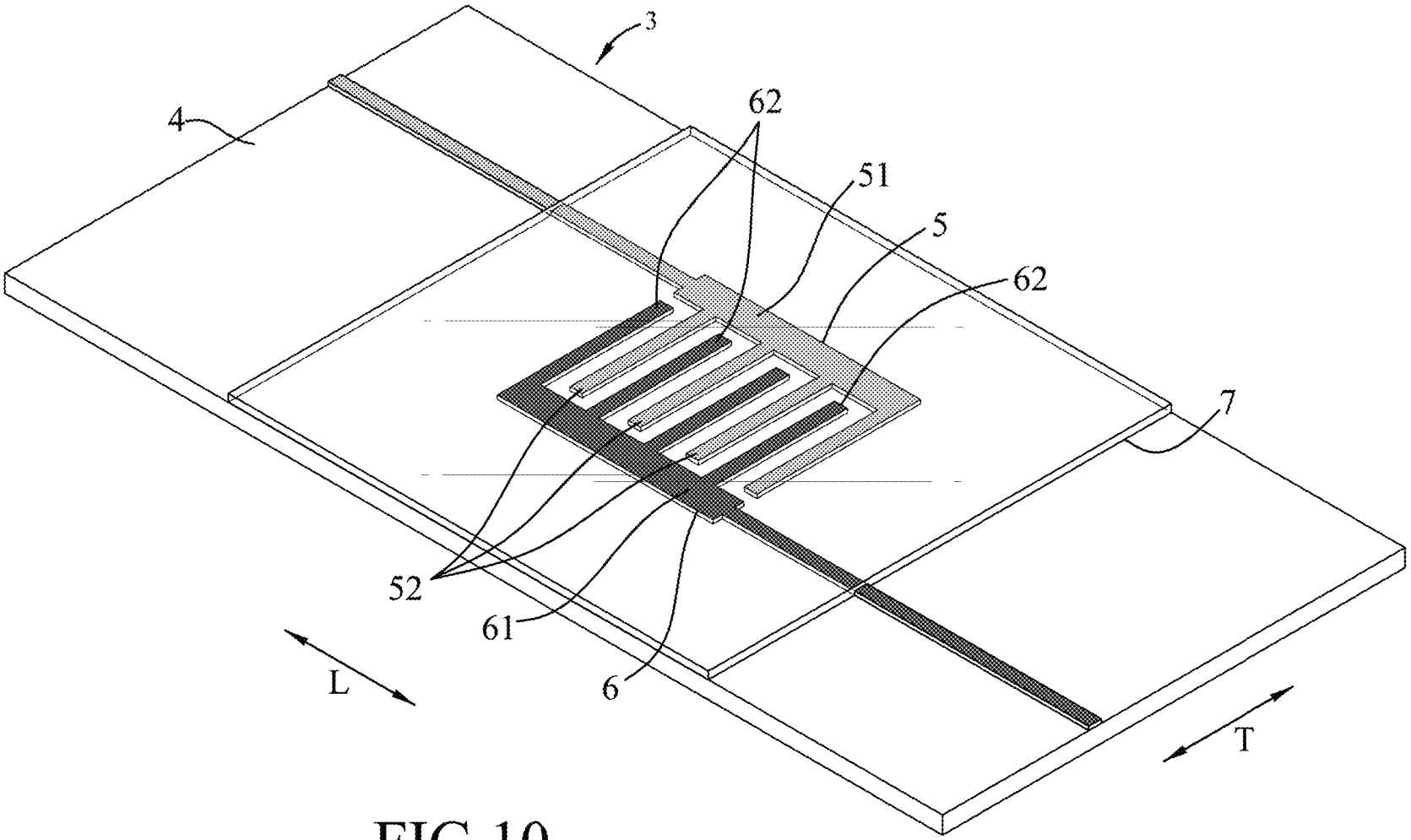
FIG. 10 is a perspective view of a second embodiment of a microfluidic chip for collecting dielectric particles in a fluid sample according to the disclosure.

Referring to FIG. 10, a second embodiment of a microfluidic chip according to the disclosure is shown to be similar to the first embodiment except for followings. In the second embodiment, the first and second base electrode portions 51, 61 are respectively configured as bars extending in a longitudinal direction (L) and displaced from each other in a transverse direction (T). The first finger electrode portions 52 are configured as strips extending in the transverse direction (T) from the first base electrode portion 51. The second finger electrode portions 62 are configured as strips extending in the transverse direction (T) from the second base electrode portion 61.

Examples of the disclosure will be described hereinafter. It is to be understood that these examples are exemplary and explanatory and should not be construed as a limitation to the disclosure.

The microfluidic chip of the first embodiment was used in following examples.

The dielectric layers of the microfluidic chips in following examples were made from silicon dioxide (dielectric constant: 3.7 F/m), hafnium dioxide (dielectric constant: 25 F/m), titanium dioxide (dielectric constant: 80 F/m), and silicon nitride (dielectric constant: 7.5 F/m), respectively. Alternatively, SU-8 photoresist was used to make the dielectric layer of the microfluidic chip in a comparative example.

The dielectric particles used in the following examples were lactic acid bacteria. The lactic acid bacteria were diluted with deionized water to prepare a fluid sample containing the lactic acid bacteria in a concentration of $1\times10^6$ CFU/ml. A microscope device (Olympus IX70) equipped with an image capture device (a microfire CCD camera) was used to capture microscopic images of the microfluidic chip at a frame rate of 10 frames/sec to analyze the flow velocity of the dielectric particles (i.e., the lactic acid bacteria).

In the comparative example, the SU-8 photoresist was applied on an insulating substrate via spin coating to form a dielectric layer having a thickness of as high as 1200 nm and overlying interdigitated electrodes on the insulating substrate. A driving voltage frequency of as high as 1000 Hz was required under a driving voltage of from 10 $V_{pp}$ to 50 $V_{pp}$ to produce alternating voltage electroosmosis force effectively for driving the flow of the dielectric particles in the fluid sample.

In the examples to illustrate the effect of various semiconductive inorganic materials (i.e., silicon dioxide, hafnium dioxide, titanium dioxide, and silicon nitride) for forming the dielectric layers on the flow velocity of the dielectric particles, the thickness of the dielectric layer was 200 nm, the driving voltage Was from 4 $V_{pp}$ to 12 $V_{pp}$, and the driving voltage frequency was from 100 Hz to 500 Hz. In the examples to illustrate the effect of the thickness of the dielectric layer on the flow velocity of the dielectric particles, the thickness of the dielectric layer was from 100 nm to 300 nm, the driving voltage was from 4 $V_{pp}$ to 12 $V_{pp}$ and the driving voltage frequency was 500 Hz.

Referring to FIGS. 4, 5, 6, and 7, in the case in which the SU-8 photoresist was used for forming the dielectric layer, the flow velocity of the dielectric particles was increased slowly when the driving voltage was increased under a driving voltage frequency of 1000 Hz. The maximum f low velocity of the dielectric particles reached under a driving voltage of 50 $V_{pp}$ and a driving voltage frequency of 1000 Hz was only 18 μm/sec.

In the case in which silicon dioxide was used for forming the dielectric layer, a relatively low driving voltage of only 4 $V_{pp}$ was required to drive the flow of the dielectric particles under driving voltage frequencies of 100 Hz, 300 Hz, and 500 Hz. The flow velocity of the dielectric particles was as high as 18 μm/sec when the driving voltage was increased to 12 $V_{pp}$.

In the case in which hafnium dioxide was used for forming the dielectric layer, the flow velocity of the dielectric particles reached under a driving voltage frequency of 100 Hz and a driving voltage of 12 $V_{pp}$ was as high as 80 μm/sec.

In the cases in which titanium dioxide and silicon nitride were used for forming the dielectric layers, high flow velocities of the dielectric particles were also produced under the aforesaid conditions.

Figure 8:
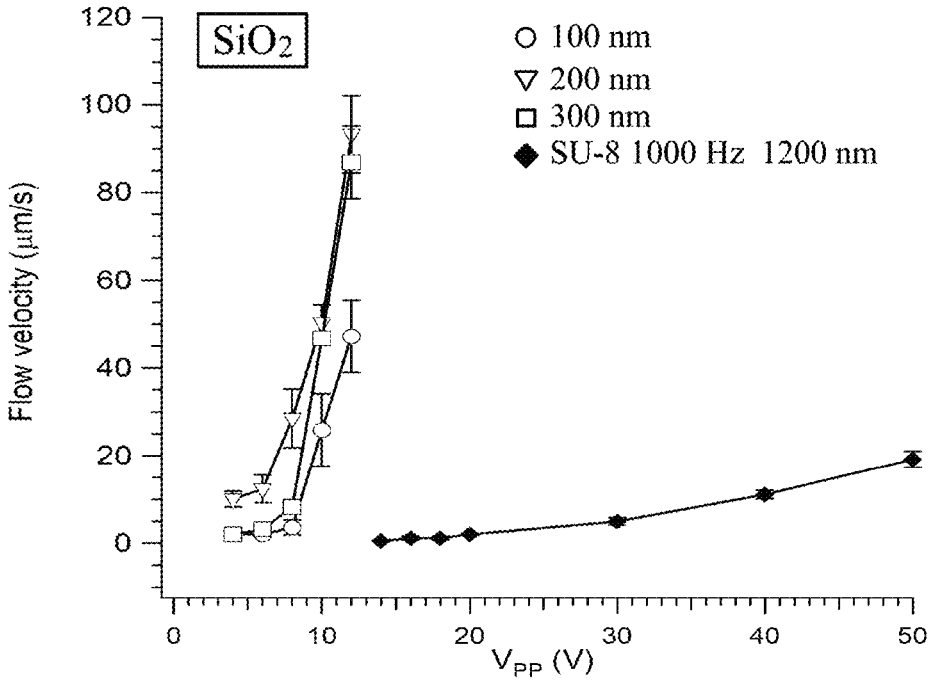
FIG. 8 is a diagram showing relationship between flow velocity and input voltage of the first embodiment in which $SiC_2$ is used for forming the dielectric layers of various thicknesses.

Referring to FIG. 8, in the case in which silicon dioxide was used for forming the dielectric layers of various thicknesses (i.e., 100 nm, 200 nm, and 300 nm), a relatively low driving voltage was required to drive the flow of the dielectric particles as compared to the driving voltage for the dielectric layer formed from the SU-8 photoresist. Specifically, the flow velocity of the dielectric particles produced using the dielectric layer formed from silicon dioxide under a driving voltage of 12 $V_{pp}$ was larger than 40 μm/sec, which was much higher than that (about 20 μm/sec) produced using the dielectric layer formed from the SU-8 photoresist.

In view of the aforesaid, in the microfluidic chip according to the disclosure, a semiconductive inorganic material having a high dielectric constant of from 3.7 F/m to 80 F/m is used to make a dielectric layer contained in the microfluidic chip such that the dielectric layer thus made has a significantly reduced thickness as compared to that of the dielectric layer contained in the dielectric particle controlling chip of the prior art. Therefore, the dielectric particles in a fluid sample to be tested in the microfluidic chip according to the disclosure can be driven under a relatively low driving voltage and a relatively low driving voltage frequency to flow at a relatively high flow velocity. The period for concentrating, collecting, and detecting the dielectric particles in the fluid sample can be significantly reduced.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment with an indication of an ordinal number," and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A microfluidic chip for collecting dielectric particles in a fluid sample to be tested, comprising:

an insulating substrate defining an electrode-forming region, which includes a first zone, a second zone spaced apart from said first zone, and an intermediate zone disposed between said first and second zones;

a first interdigitated electrode including:

a first base electrode portion deposited on said first zone; and a plurality of first finger electrode portions, which are deposited on said intermediate zone and displaced from each other, and each of which extends from said first base electrode portion toward said second zone to terminate at a first finger end;

a second interdigitated electrode including:

a second base electrode portion deposited on said second zone and spaced apart from said first finger end of each of said first finger electrode portions by a first clearance; and a plurality of second finger electrode portions, which are deposited on said intermediate zone, and which extend from said second base electrode portion toward said first zone to interdigitate with said first finger electrode portions of said first interdigitated electrode, each of said second finger electrode portions having a second finger end which is spaced apart from said first base electrode portion of said first interdigitated electrode by a second clearance; and a dielectric layer which is formed on said first and second interdigitated electrodes and which is made from a semiconductive inorganic material having a dielectric constant of from 3.7 F/m to 80 F/m.

2. The microfluidic chip according to claim 1, wherein said semiconductive inorganic material is selected from the group consisting of silicon dioxide, hafnium dioxide, titanium dioxide, silicon nitride, and combinations thereof.

3. The microfluidic chip according to claim 1, wherein said dielectric layer has a thickness ranging from 100 nm to 300 nm.

4. The microfluidic chip according to claim 1, wherein said dielectric layer is formed by a coating process selected from the group consisting of electroplating, physical vapor deposition, chemical vapor deposition, spin coating, and combinations thereof.

5. The microfluidic chip according to claim 1, wherein said first base electrode portion is of a circular shape, said first finger electrode portions extend radially and outwardly from said first base electrode portion, said second base electrode portion is of an annular shape surrounding said first finger electrode portions, and said second finger electrode portions extend radially and inwardly from said second base electrode portion.

6. The microfluidic chip according to claim 5, wherein each of said first finger electrode portions is configured as a strip, and each of said second finger electrode portions is configured to converge toward said first base electrode portion.

7. The microfluidic chip according to claim 1, wherein said first and second base electrode portions are respectively configured as bars extending in a longitudinal direction and displaced from each other in a transverse direction.

8. The microfluidic chip according to claim 7, wherein said first finger electrode portions are configured as strips extending in the transverse direction from said first base electrode portion, and said second finger electrode portions are configured as strips extending in the transverse direction from said second base electrode portion.

* * * * *